US005339993A

United States Patent [19]

Groya et al.

[11] Patent Number: 5,339,993

[45] Date of Patent: Aug. 23, 1994

[54] SHAKER CLOSURE

[75] Inventors: Robert J. Groya, Norridge; Richard W. Hofmann, Chicago, both of Ill.

[73] Assignee: Magenta Corporation, Chicago, Ill.

[21] Appl. No.: 851,172

[22] Filed: Mar. 13, 1992

[51] Int. Cl.[5] ..... B65D 47/00

[52] U.S. Cl. ..... 222/153; 222/556; 222/565; 215/237; 220/254; 220/339

[58] Field of Search ..... 222/480, 481, 482, 556, 222/565, 498, 153; 215/235, 237, 238; 220/254, 335, 339

[56] References Cited

U.S. PATENT DOCUMENTS

| | | | |
|---|---|---|---|
| 3,018,931 | 1/1962 | Westgate | 222/556 X |
| 3,493,150 | 2/1970 | Lucas et al. | 222/480 |
| 3,499,588 | 3/1970 | Bartilson et al. | 222/565 X |
| 3,675,812 | 7/1972 | Foster | 222/565 X |
| 3,966,080 | 6/1976 | Bittel | 222/565 X |
| 4,262,802 | 4/1981 | Laauwe | 220/339 X |
| 4,580,687 | 4/1986 | Lewis | 222/556 X |
| 4,607,768 | 8/1986 | Taber et al. | 222/556 |
| 4,874,103 | 10/1989 | Quisenberry et al. | 220/254 |
| 4,949,865 | 8/1990 | Turner | 220/254 X |
| 4,991,730 | 2/1991 | Pehr | 215/238 X |
| 5,085,331 | 2/1992 | Groya et al. | 220/254 X |

FOREIGN PATENT DOCUMENTS

| | | | |
|---|---|---|---|
| 3530373 | 2/1987 | Fed. Rep. of Germany | 222/556 |
| 0837925 | 6/1960 | United Kingdom | 222/565 |

*Primary Examiner*—Andres Kashnikow
*Assistant Examiner*—Anthoula Pomrening
*Attorney, Agent, or Firm*—Laff, Whitesel, Conte & Saret, Ltd.

[57] ABSTRACT

A shaker closure generally comprising a skirt and a shaker lid, a portion of which is adapted to pivot from a closed position to an open dispensing position. A well deck having a plurality of orifices extends across a portion of the closure top and is covered when the pivotable lid portion is in the closed position. A releasable lock is provided to securely and releasably lock the shaker lid in the closed position. The lock is an eccentric detent formed on the periphery of the pivotable lid portion and an undercut formed on the skirt adapted to releasably engage the detent. A second lock may be provided to hold a generally semi-circular lid in a fully open position, the second lock comprising a pair of arcuate latch projections formed on the periphery of the pivotable lid above the detent and a pair of arcuate locking walls formed on the skirt adapted to releasably engage the latch projections. Also provided are seals for the orifices when the lid is in the closed position to prevent small amounts of granular contents from passing through the orifices. The seals are provided by a membrane surrounding each of the orifices and a plurality of rounded protuberances formed on the bottom of the pivotable lid that are adapted to align with the orifices and sealingly engage the membrane to seal the orifices when the lid is in the closed position.

17 Claims, 3 Drawing Sheets

SHAKER CLOSURE

FIELD OF THE INVENTION

The present invention relates to a closure cap to be used with a container, and more specifically, to a shaker closure to be used in storing and dispensing of the contents of a container.

BACKGROUND OF THE INVENTION

Containers are normally fitted with closure caps which are frequently molded plastic cap members. Shaker tops having a plurality of orifices generally are used with such closure caps where the contents of the container comprise granular substances, such as baby powder, salt, or the like. There are many examples of molded closures equipped with shaker tops, including, for example, devices where a portion of the end piece or top of the dispensing cap is pivotable from a closed position to an open shaker dispensing position. The pivoting top is often difficult to work with because, after initially being opened, it is either difficult to close and/or reopen. Another problem is that the pivoting top, when open, often tends to wave back and forth and thus obstruct the flow of the container contents being dispensed. Also, even when the pivoting top is in the closed position, it is still possible for granular contents in the container to exit through the orifices in light of the clearance that normally exists between the orifices and the pivoting top.

U.S. Pat. No. 4,361,250 of Foster discloses a plastic closure cap which holds its pivotable flap in the closed position and provides a visual indication as to whether the product has been opened prior to purchase by a consumer. After an initial opening of the container, the pivotable flap may be releasably held in a closed position by lugs which engage the edge of an opening. Similarly, U.S. Pat. No. 4,714,181 of Kozlowski et. al discloses a condiment bottle cap including a pivotable lid having a plurality of spaced flanges on the underside of the lid adapted to engage an edge of the hole opening with either an interference or friction fit. The disclosed caps do not include resilient means on their skirts to securely retain the flap in the closed position.

Thus, it is an object of the present invention to provide a shaker closure not heretofore known which can readily and easily be opened and closed and which can be securely locked in the closed position.

It is a further object to provide the above shaker closure cap with an improved means for plugging or sealing the orifices of the shaker cap when the hinged top is in the closed position to prevent small amounts of granular contents from passing through the orifices.

SUMMARY OF THE INVENTION

In accordance with these and other objectives, a shaker closure is provided which generally comprises a skirt and a lid. The closure is preferably a one-piece molded plastic closure with a top well deck having a plurality of orifices for dispensing the contents of the container. The well deck is below the skirt top end. The well deck is closed by the lid that is hinged to a fixed portion of the top end wall of the cover. The pivotable lid portion pivots from a closed position covering the well deck to an open shaker dispensing position exposing the well deck. Means for securing and releasably locking the pivotable lid in the closed position, as hereinafter described, are also provided. Also, when desired, means are provided to hold a relatively semi-circular lid in the fully open dispensing position. A tongue is provided on the pivotable lid portion and a first slot is formed on the skirt, the first slot being adapted to receive the tongue when the pivotable lid portion is in the closed position. When the lid is semicircular, a second slot may be provided to receive the tongue when the pivotable lid portion is in the open dispensing position. The tongue extends a predetermined distance from the periphery or the lid and extends beyond the skirt when it is received by one of the slots.

On the bottom of the pivotable lid a plurality of rounded protrusions are formed that are adapted to align with and cover the orifices of the well deck when the pivotable lid portion is in its closed position. Counter bores are formed in the inner surfaces of the well deck at each orifice to provide a thin flexible membrane adjacent each orifice. The protrusions are adapted to mate with the flexible membranes and seal the orifices to prevent small amounts of the contents of the container to pass through the orifices when the pivotable lid portion is in the closed position. This sealing means may also compensate for molding variances and out of flat conditions.

The means for releasably locking the pivotable lid portion in the closed position comprises a detent extending around a portion of the outer periphery of the pivotable lid portion, and an undercut extending around the periphery of the skirt adjacent the well deck that releasably engages the detent. Preferably, the detent is eccentric to the periphery of the pivotable lid portion to provide a smooth transition between the locking and above-described sealing means. In addition, preferably, the undercut comprises a pair of angled walls which facilitate the engagement and disengagement of the undercut with the detent. The undercut upper wall extends from the inner surface of the well downwardly at an angle relative to the interior vertical axis of the skirt of from about 20° to about 40° and preferably about 30°. The lower wall extends from the end of the undercut top wall to the inner surface of the wall at an angle relative to the interior vertical axis of the skirt of from about 5° to about 15° and preferably about 10°.

The means for locking the semicircular lid in the open dispensing position comprises a pair of arcuate latch projections formed on the periphery of the pivotable lid portion, and a pair of locking walls formed on the skirt adjacent the fixed cover portion that is releasably engageable with the latch projections. Preferably, the tongue is located between the two latch projections, and the second slot is located between the two locking walls.

The present invention and advantages thereof will become more apparent upon consideration of the following detailed description when taken in conjunction with the accompanying drawings.

DESCRIPTION OF THE PREFERRED EMBODIMENTS

Figure 1:
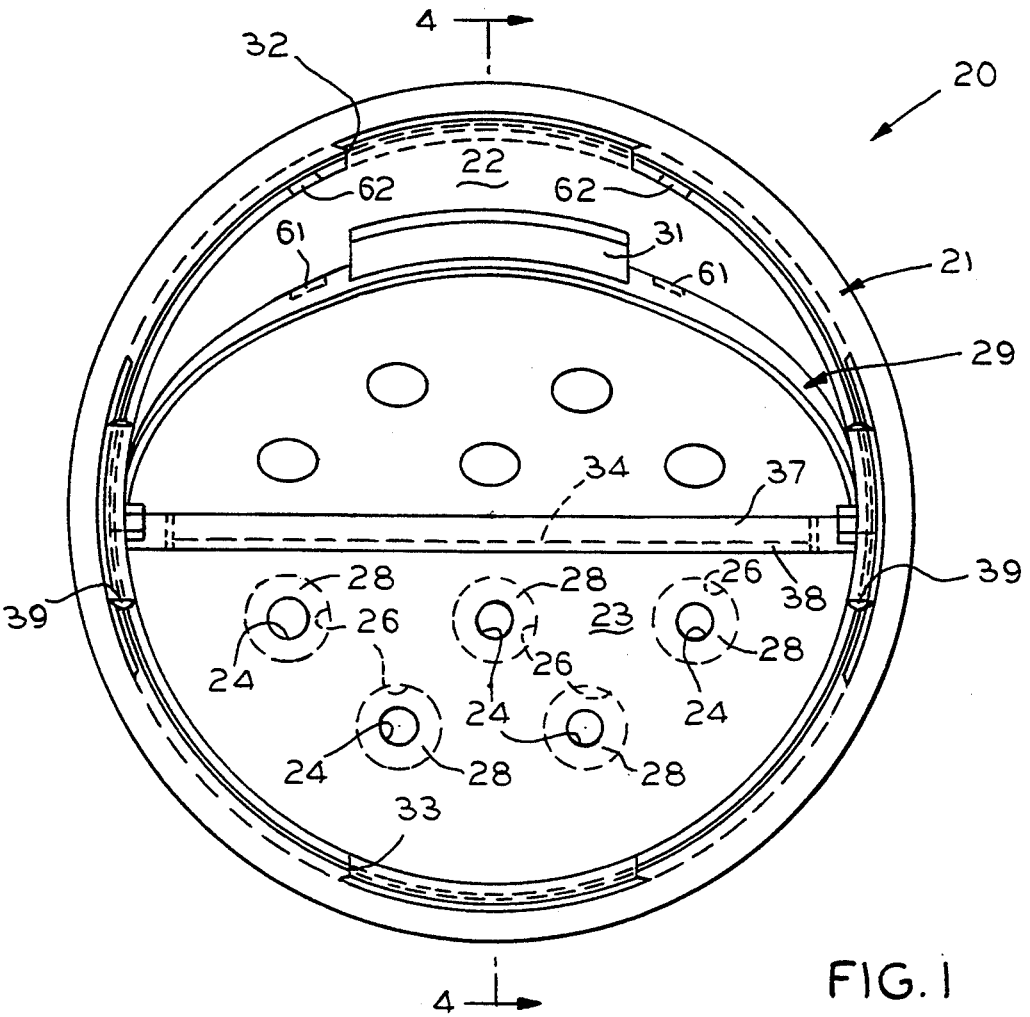
FIG. 1 is a top plan view of the shaker closure of this invention with the pivotable lid in a partially open position pivoting towards the open dispensing position.

FIGS. 1–7 illustrate a one-piece molded plastic shaker closure or cap 20 for a container. The shaker closure is especially useful for dispensing granular substances, such as baby powder, salt, and the like which usually require the contents to be dispensed from the container through small orifices.

Cap 20 comprises an annular skirt 21. The skirt 21 has a top end 21*a*, and open bottom end 21*b*, an annular lower wall 21*c*, a frustro conical wall 21*d* conveying from said lower annular wall 21*c* to said top end 21*a*. The cap has a shaker top end which extends below the top 21*a* of the skirt. This top portion of the skirt provides a lip surrounding the shaker top end. The shaker top end has a non-perforated portion 22 and a well deck 23, shown best in FIGS. 1–2. Well deck 23 as shown is generally semicircular and integral with the skirt. A plurality of orifices 24 are formed in the well deck for dispensing the contents of the container. In addition, a counter bore 26 is provided on the under or inner surface 27 (FIG. 4) of well deck 23 at each orifice 24 to define a flexible membrane 28. The top non-perforated portion 22 is positioned above the wall deck 23.

A pivotable lid 29 is connected to the non-perforated portion to open and close the well deck orifices 24. In this embodiment the lid 29 is generally semicircular. Pivotable lid 29 includes a tongue 31 which extends a predetermined distance from the periphery of the pivotable lid. The lip of the skirt surrounding the non-perforated portion 22 has a first slot 32 formed therein which is sized to accept the tongue 31 when the lid 29 is in its fully open position. The first slot extends from the top 21*a* of the skirt to the upper surface of the non-perforated top end wall 22.

A second slot 33 is formed in the skirt diametrically opposite the first slot 32. The second slot is sized to accept the tongue 31 when the lid 29 is in its closed position. The second slot extends from the top 21*a* of the skirt to the top of the undercut formed on the skirt adjacent to the well deck.

A living hinge 34 connects the pivotable lid 29 to the non-perforated portion 22 to enable lid 29 to pivot from a closed position covering well deck 23 to an open dispensing position exposing well deck 23. Preferably, living hinge 34 is formed by an angle cut from the underside of the non-perforated portion 22, to define an inclined wall 36. The inclined wall 36 extends from the undersurface of the fixed portion 22 to the undersurface 27 of the well deck 23. Also, the well deck end wall 38 inclines upwardly from the well deck 23 to the living hinge 34. The angle of end wall 38 is from about 30° to about 60° with about 45° being preferred. The end wall 36 is complimentary to the cover relatively flat end wall 37. When the lid 29 is in its closed position, the walls 37 and 38 are generally in contact with each other. The width of the wall 37 is preferably equal to the width of end wall 38. The thickness 29*a* of the cover preferably is approximately the same as the depth 23*a* of the well when the top of the cover is considered as being on the same plane as the upper surface of the non-perforated portion 22.

Living hinge 34 may extend across the center line of cover 20 so that non-perforated portion 22 and pivotable lid 29 are approximately the same size, or the living hinge may extend off center so that the non-perforated portion and lid are different sizes.

A pair of third and fourth slots 39 are formed in the skirt and extend from the top 21*a* of the skirt to the upper surface of the top end wall 22. The slots 39 are opposite each other at the end of the hinge 34 and each slot extends beyond the hinge 34.

A plurality of segmented spherical protuberances 41 are formed on the bottom of pivotable lid 29. Protuberances 41 are adapted to align and mate with the orifices 24. The flexible membranes 28 have a diameter that is greater than the width 44 of the protuberances 41. The width 44 is greater than the diameter of hole 24. The height of the protuberances 41 is less than the depth of the counter bore 26. Therefore, when pivotable lid 29 is in its closed position a portion of the protuberances 41 extend through the corresponding holes 24 and causes the membranes 28 to flex and thus plug or seal the orifices 24. The protuberances and membranes thereby prevent granules from passing through the orifices when the pivotable lid is in the closed position.

Figure 7:
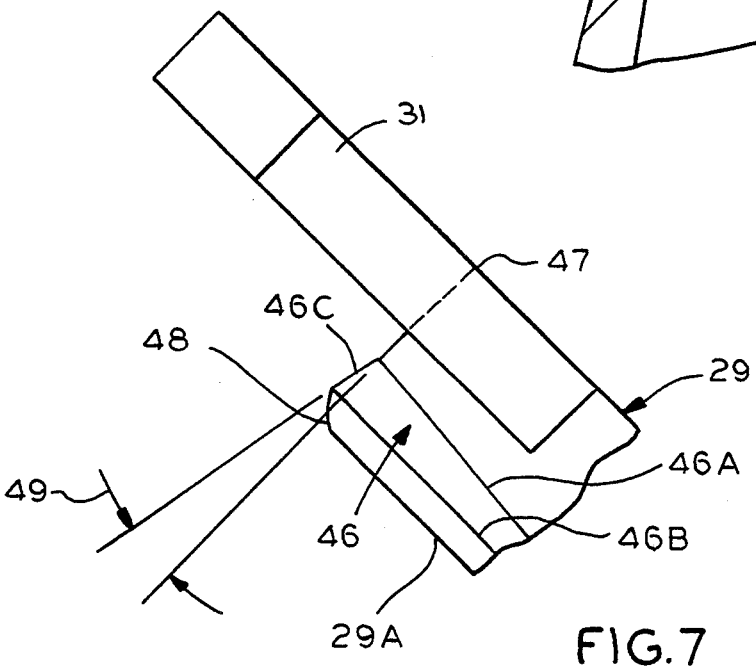
FIG. 7 is a partial enlarged view of the circled portion of FIG. 4 designated 7—7 illustrating the detent on the pivotal lid.

The means provided for releasably locking pivotable lid 29 in the closed position is in the form of a detent 46 (FIGS. 3 and 7) formed on the periphery of pivotable lid 29. Preferably, detent 46 is eccentric to the outer periphery of pivotable lid 29 to provide a smooth transition between the locking and the above-described sealing means. Referring to FIG. 7, the outer circumference of the lid 29 has top 47 and a base 48. The detent 46 is below the tongue 31 and above base 48. The detent 46 has a top 46A and a bottom 46B. The outer periphery 46C of the detent diverges at an angle 49 from about 5° to about 15° and preferably at about 10° from the top 46A to the bottom 46B. The bottom 46B is substantially parallel with the bottom 29A. The detent top 46A converges to meet the bottom 46B so that the width of the detent gradually disappears.

Figure 3:
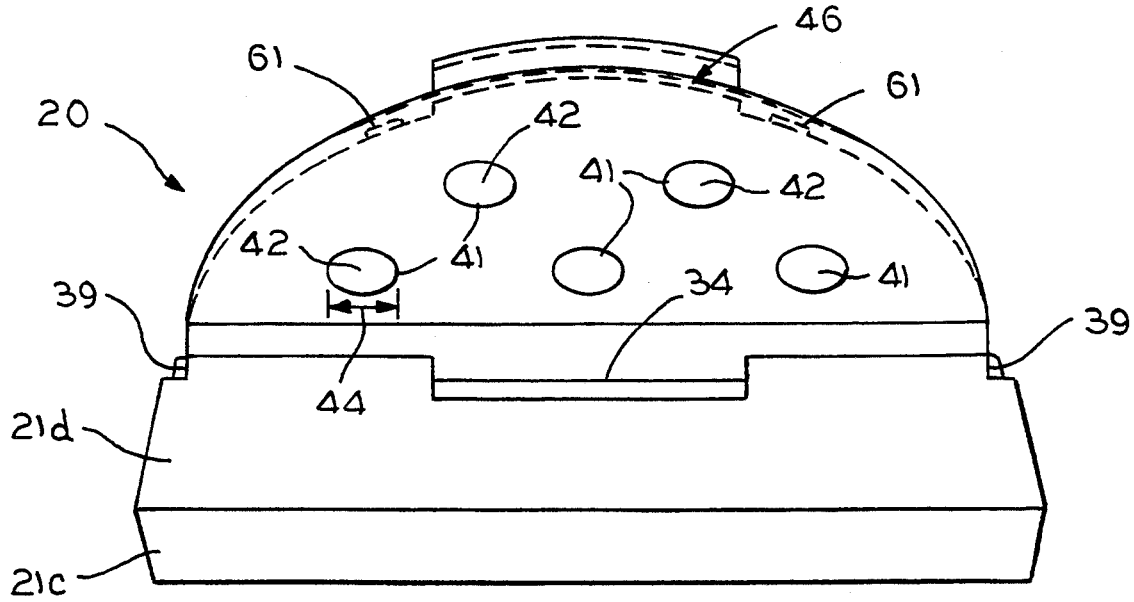
FIG. 3 is a front view of the shaker closure of FIG. 1.

An alternative to this would be to have the width of the detent remain constant while the angle 49 slowly decreases to have the detent gradually disappear. The detent extends from about 25% to about 75% and preferably from about 40% to about 60% of the lid periphery. As shown in FIG. 3, the detent 46 blends into the periphery at about 45° on both sides of a center line through the tongue 31. Thus the detent arc is about 90° which is about 50% of the lid periphery which extends about 180°. The base 48 of the lid has a rounded edge to allow the detent to engage a catch means on the inner walls of the well.

Figure 5:
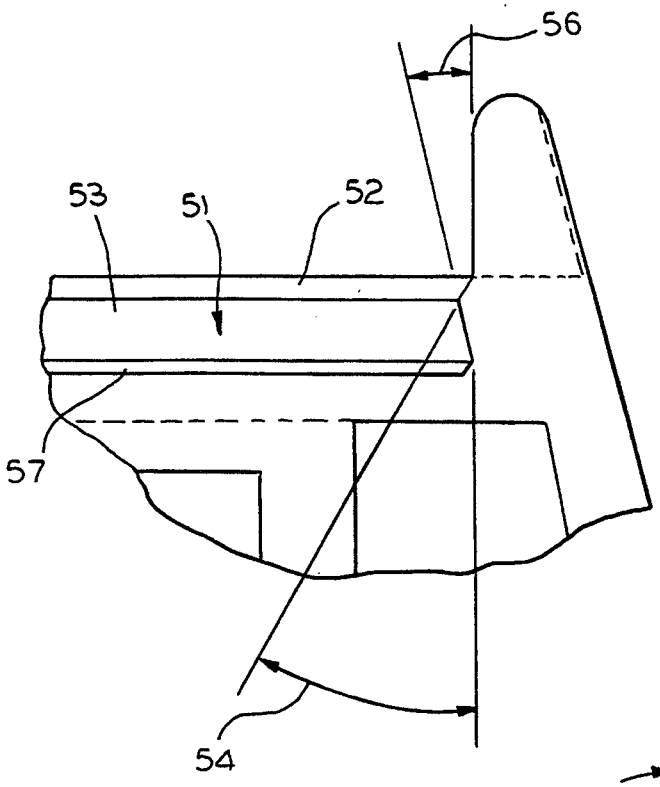
FIG. 5 is an enlarged view of the circled portion of FIG. 4 designated 5—5, illustrating the undercut formed on the skirt adjacent the well deck.

As shown in FIG. 5, a lid catch is provided on the skirt lip surrounding the well deck 23. The catch generally is provided by an undercut 51 which starts at about the level of the plane of non-perforated portion. The undercut 51 has a pair of walls 52, 53 extending inwardly from skirt 26 at a predetermined angle to provide a latch camming effect that facilitates the releasable engagement and disengagement of detent 46 from undercut 51. The undercut top wall 52, which facilitates the engagement of the detent, extends downward from the plane at an angle 54. The angle 54 is from about 20° to about 40° and preferably at about 30° relative to the inner skirt wall. The disengagement of the detent 46 with the undercut 51 may be effected by upward manual pressure applied to tongue 31.

The catch wall 53 converges from the wall 52 to the inner well wall at about or just above the well deck 23 and forms an angle 56 with skirt or well wall. The angle 56 is from about 5° to about 15° and preferably 10°. Preferably, along the periphery of the deck 23 and, below the catch 51, there is a rounded concave surface 57 that is complimentary with the convex lid base 48. The catch 51 extends completely within the well i.e. for about 180° where the well deck is semi-circular.

Figure 4:
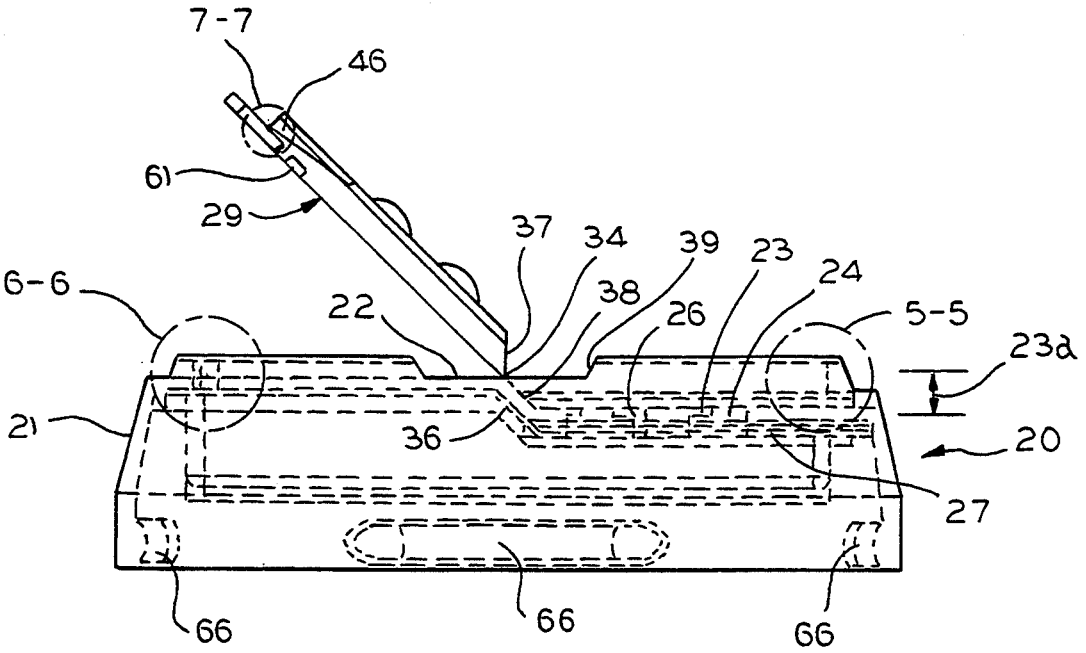
FIG. 4 is a partial cross-sectional view of the shaker closure taken along lines 4—4 of FIG. 1.
Figure 2:
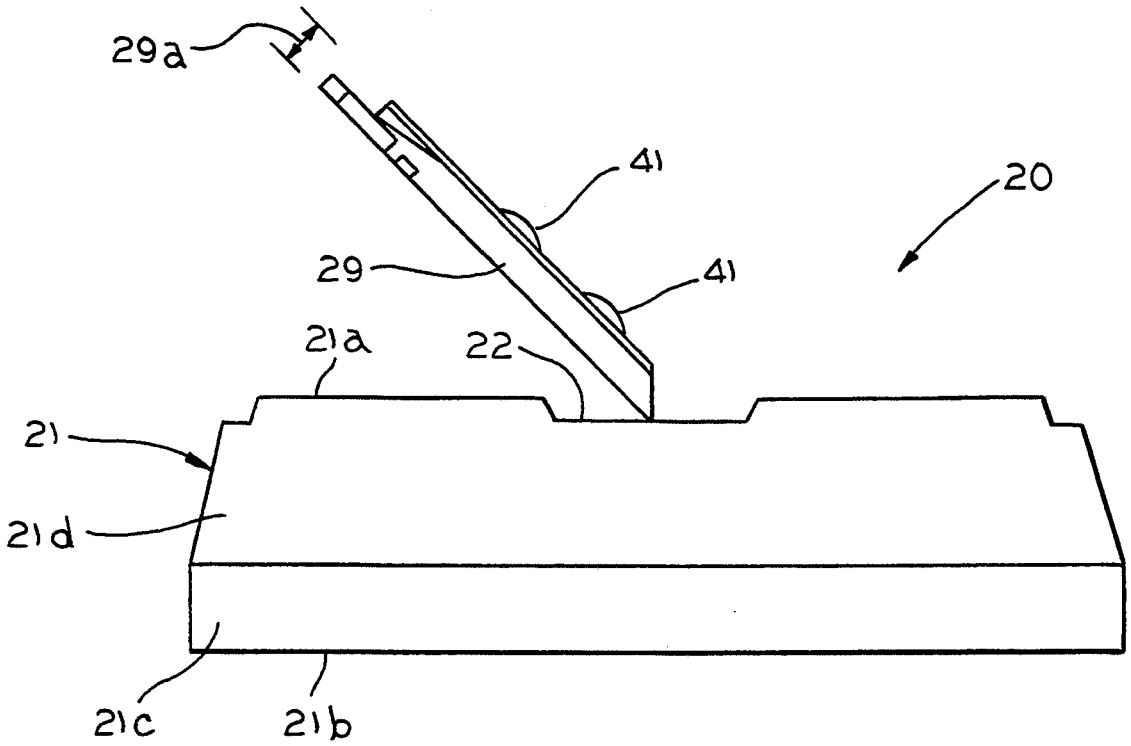
FIG. 2 is a side view of the shaker closure of FIG. 1.
Figure 6:
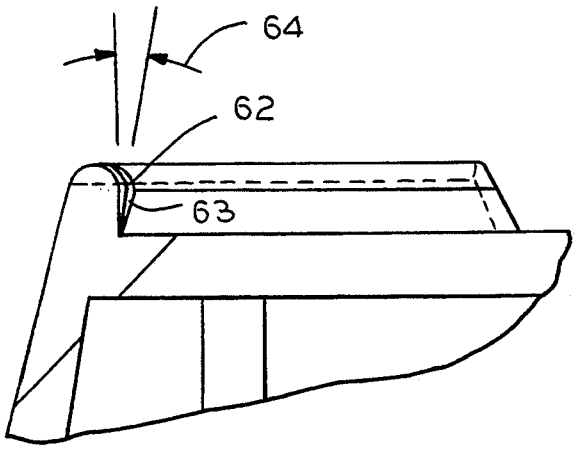
FIG. 6 is an enlarged view of the circled portion of FIG. 4 designated 6—6, illustrating one of the locking walls formed on the skirt adjacent the fixed portion of the cover.

In addition, a means for releasably locking pivotable lid 29 in the open dispensing position may be provided and is shown in FIGS. 1, 4 and 6. The holder is provided by a pair of arcuate latch projections 61 formed on the periphery of pivotable lid 29 near its top 47, and a pair of corresponding arcuate locking walls 62 formed on inner surface of the skirt and having a base 63 projecting from the skirt inner surface and adapted to releasably engage the arcuate latch projections 61. Preferably, the arcuate locking walls extend upwardly at a an angle 64 relative to skirt. The angle 64 is from about 5° to about 15° and preferably about 10°. The disengagement of the arcuate latch projections 61 with the arcuate locking walls 62 may be effected by manual upward pressure applied to tongue 31. Preferably, tongue 31 is located between the two latch projections 61, and second slot 32 is located between the two locking walls 62.

The interior of the skirt bottom wall 21c has thread means to screw the cap 20 onto the container or snap fit beads 66. It is appreciated, however, that any suitable structure adapted to engage a container holder may be included on the skirt.

It will be apparent that various embodiments may be resorted to without departing from the spirit and scope of the following claims.

We claim:

1. A shaker closure for a container comprising:

a skirt, said skirt having an open skirt bottom end and a top end, said bottom end adapted to attach said closure to the container;

a shaker top end having a non-perforated portion, a shaker portion, and a pivotable lid to open and close said shaker portion, said skirt top end surrounding said shaker top end;

said shaker portion having a plurality of orifices;

said pivotable lid hingedly connected to said non-perforated portion and adapted to pivot from a closed position covering said orifices to an open dispensing position exposing said orifices;

means for sealing said orifices when said pivotable lid is in its closed position; and means for releasably locking said lid in a closed position;

wherein said sealing means comprise a plurality of counter bores formed on a bottom surface of said shaker portion and surrounding said orifices defining a plurality of flexible membranes surrounding said orifices, and a plurality of protuberances extending from an inner surface of said lid and being larger than said orifices, said protuberances flex said membranes and thereby seal said orifices when said pivotable lid is in the closed position.

2. The shaker closure of claim 1 wherein the releasable locking means comprises a detent formed on the periphery of said pivotable lid near the inner surface of said pivotable lid and an undercut formed on said skirt adjacent said shaker portion and adapted to releasably engage said detent.

3. The shaker closure of claim 2 wherein one of said detent or undercut extends from about 25% to about 75% of the periphery of said respective lid or said skirt adjacent said shaker portion.

4. The shaker closure of claim 3 wherein said detent is eccentric to said pivotable lid.

5. The shaker closure of claim 4 wherein said detent has a width which decreases to zero.

6. The shaker closure of claim 2 wherein the undercut is defined by a first wall adapted to facilitate engagement of said detent and a second wall adapted to facilitate disengagement of said detent, said first wall extending downward at a first angle relative to said skirt and said second wall extending upward from said skirt to said first wall at a second angle relative to said skirt.

7. The shaker closure of claim 6 wherein said first angle is from about 20° to about 40° and said second angle is from about 5° to about 15°.

8. The shaker closure of claim 6 wherein the shaker top end is substantially circular and the non-perforated portion, the pivotable lid, and the shaker portion are each substantially semicircular.

9. The shaker closure of claim 1 wherein said protuberances are formed on the bottom of said pivotable lid and are segmented spheres.

10. A shaker closure for a container comprising:

a skirt, said skirt having an open skirt bottom end and a top end, said bottom end adapted to attach said closure to the container;

a shaker top end having a non-perforated portion, a shaker portion, and a pivotable lid to open and close said shaker portion, said skirt top end surrounding said shaker top end;

said shaker portion having a plurality of orifices;

said pivotable lid hingedly connected to said non-perforated portion and adapted to pivot from a closed position covering said orifices to an open dispensing position exposing said orifices;

means for sealing said orifices when said pivotable lid is in its closed position; and means for releasably locking said lid in a closed position;

wherein said sealing means comprise a plurality of counter bores formed on a bottom surface of said shaker portion and surrounding said orifices defining a plurality of flexible membranes surrounding said orifices, and a plurality of protuberances extending from an inner surface of said lid and being larger than said orifices, said protuberances adapted to flex said membranes and thereby seal said orifices when said pivotable lid is in the closed position;

wherein the releasable locking means comprises a detent formed on the periphery of said pivotable lid near the inner surface of said pivotable lid and an undercut formed on said skirt adjacent said shaker portion and adapted to releasably engage said detent;

wherein the undercut is defined by a first wall adapted to facilitate engagement of said detent and a second wall adapted to facilitate disengagement of said detent, said first wall extending downward at a first angle relative to said skirt and said second wall extending upward from said skirt to said first wall at a second angle relative to said skirt;

wherein the shaker top end is substantially circular and the non-perforated portion, the pivotable lid, and the shaker portion are each substantially semicircular; and a releasable second locking means comprising a pair of arcuate latch projections formed on the periphery of said pivotable lid near the top of said pivotable lid and a pair of arcuate locking walls formed on said skirt adjacent said non-perforated portion, said arcuate locking walls adapted to releasably engage said arcuate latch projections when said lid is pivoted to a fully open position.

11. The shaker closure of claim 10 wherein said lid has a tongue extending from the periphery thereof and said tongue being located between said pair of arcuate latch projections and a slot formed in said skirt adjacent said non-perforated portion, said slot adapted to receive said tongue when said lid is in its open position and said slot located between said pair of arcuate locking walls.

12. A one-piece molded plastic shaker closure for a container comprising:

a skirt;

a shaker portion well deck that is generally semicircular and integral with said skirt, said well deck having a plurality of orifices and a thin annular membrane around each orifice;

a non-perforated portion above said well deck, a pivotable lid that is generally semicircular and has top and bottom surfaces, said pivotable lid having a plurality of rounded protuberances formed on said bottom surface, a hinge connecting said non-perforated portion to said pivotable lid, and a tongue extending from the periphery Of said pivotable lid adapted to pivot from a closed position covering said well deck to an open dispensing position exposing said well deck, said rounded protuberances adapted to mate with said orifices and flex said membranes and seal said orifices when said pivotable lid is in the closed position;

a first slot formed in said skirt adjacent said well deck, said first slot positioned to receive said tongue when said pivotable lid is in the closed position;

a second slot formed in said skirt adjacent said non-perforated portion, said second slot positioned to receive said tongue when said pivotable lid is in the open position;

a detent formed on the periphery of said pivotable lid adjacent said lid bottom surface and an undercut formed on said skirt adjacent the periphery of said well deck and positioned to releasably engage said detent, said detent being eccentric to said pivotable lid, said undercut having a triangular cross section and being defined by a first wall extending downward toward said well deck at a first angle relative to said skirt and a second wall extending from said first wall toward said well deck to said skirt at a second angle relative to said skirt; and a means for releasably locking said pivotable lid in the open dispensing position comprising a pair of arcuate latch projections formed on the periphery of said pivotable lid near said lid top surface and a pair of arcuate locking walls formed on said skirt adjacent said non-perforated portion adapted to releasably engage said pair of latch projections, said tongue being located between said pair of arcuate latch projections and said second slot being located between said pair of arcuate locking walls.

13. The shaker closure of claim 14 wherein said hinge is defined by a cut made into said bottom of said pivotable lid.

14. A one-piece molded plastic shaker closure for a container comprising:

a skirt;

a shaker portion well deck that is generally semicircular and integral with said skirt, said well deck having a plurality of orifices and a thin annular membrane around each orifice;

a non-perforated portion above said well deck, a pivotable lid that is generally semicircular and has top and bottom surfaces, said pivotable lid having a plurality of rounded protuberances formed on said bottom surface, a hinge connecting said non-perforated portion to said pivotable lid, and a tongue extending from the periphery of said pivotable lid adapted to pivot from a closed position covering said well deck to an open dispensing position exposing said well deck, said rounded protuberances adapted to mate with said orifices and flex said membranes and seal said orifices when said pivotable lid is in the closed position;

a first slot formed in said skirt adjacent said well deck, said first slot positioned to receive said tongue when said pivotable lid is in the closed position;

a second slot formed in said skirt adjacent said non-perforated portion, said second slot positioned to receive said tongue when said pivotable lid is in the open position;

a detent formed on the periphery of said pivotable lid adjacent said lid bottom surface and an undercut formed on said skirt adjacent the periphery of said well deck and positioned to releasably engage said detent, said detent being eccentric to said pivotable lid, said undercut having a triangular cross section and being defined by a first wall extending downward toward said well deck at a first angle relative to said skirt and a second wall extending from said first wall toward said well deck to said skirt at a second angle relative to said skirt;

a means for releasably locking said pivotable lid in the open dispensing position comprising a pair of arcuate latch projections formed on the periphery of said pivotable lid near said lid top surface and a pair of arcuate locking walls formed on said skirt adjacent said non-perforated portion adapted to releasably engage said pair of latch projections, said tongue being located between said pair of arcuate latch projections and said second slot being located between said pair of arcuate locking walls;

wherein said hinge is defined by a cut made into said bottom of said pivotable lid; and wherein said cut interconnects said non-perforated portion to said well deck, a top of said cut being the hinge connecting said non-perforated portion to said lid and a base of said cut being connected to said well deck.

15. The shaker closure of claim 14 wherein said detent extends away from the periphery of said pivotable lid at an angle of from about 5° to about 15° and extends along the periphery of the lid from about 60° to about 120°.

16. The shaker closure of claim 15 wherein said first angle of said undercut on said skirt is from about 20° to about 40° and said second angle is from about 5° to about 15°.

17. The shaker closure of claim 16 wherein said cut extends at an angle of about 45° from the plane of the non-perforated portion.

* * * * *